US005489467A

United States Patent [19]

McKeon et al.

[11] Patent Number: 5,489,467

[45] Date of Patent: Feb. 6, 1996

[54] PAPER MAKING FABRIC WOVEN FROM POLYESTER MONOFILAMENTS HAVING HYDROLYTIC STABILITY AND IMPROVED RESISTANCE TO ABRASION

[75] Inventors: Timothy E. McKeon, Columbia; James H. Moreland, Irmo; Michelle Diaz-Kotti, Columbia, all of S.C.

[73] Assignee: Shakespeare Company, Columbia, S.C.

[21] Appl. No.: 422,845

[22] Filed: Apr. 17, 1995

Related U.S. Application Data

[63] Continuation-in-part of Ser. No. 106,272, Aug. 12, 1993, Pat. No. 5,407,736.

[51] Int. Cl.[6] ..... D03D 3/00

[52] U.S. Cl. ..... 428/229; 139/383; 428/225

[58] Field of Search ..... 428/225, 229; 525/165, 177; 139/383

[56] References Cited

U.S. PATENT DOCUMENTS

| | | | |
|---|---|---|---|
| 3,005,795 | 10/1961 | Busse et al. | 260/45.5 |
| 3,294,871 | 12/1966 | Schmitt et al. | 260/900 |
| 3,723,373 | 3/1973 | Lucas | 260/29.6 F |
| 3,975,329 | 8/1976 | Barnewall et al. | 260/75 T |
| 4,144,285 | 3/1979 | Maschek et al. | 260/873 |
| 4,191,678 | 3/1980 | Smith | 260/40 R |
| 4,221,703 | 9/1980 | Hoeschele | 260/45.9 NC |
| 4,284,549 | 8/1981 | Salee | 260/40 R |
| 4,610,916 | 9/1986 | Ballard | 428/224 |
| 4,639,480 | 1/1987 | Birum et al. | 524/104 |
| 4,965,338 | 10/1990 | Tabankia et al. | 528/272 |
| 5,169,499 | 12/1992 | Eagles et al. | 428/175 |
| 5,246,992 | 9/1993 | Wick et al. | 524/195 |
| 5,283,110 | 2/1994 | Gardner et al. | 428/227 |
| 5,297,590 | 3/1994 | Fleischer | 139/383 A |
| 5,378,537 | 1/1995 | Masuda et al. | 428/364 |
| 5,407,736 | 4/1995 | McKeon | 428/225 |

FOREIGN PATENT DOCUMENTS

WO90/12918 4/1990 WIPO .

OTHER PUBLICATIONS

Material Safety Data Sheet for Produce Name "EASTMAN", Eastman Kodak, pp. 1–6, (Apr. 1993).

"PCT Polyester for Paper Machine Belts", Eastman Chemical Company, 7 pages, (undated).

"Polyethylene terephthalate: PET, standard grades" by Nitschke, *Modern Plastics*, pp. 46–48, (Oct. 1991).

"Stabaxol®Solution for Hydrolysis Problems", Rhein Chemie, 10 pages, (1990).

Staboxol®KE 7646, Rhein Chemie Rheinau GmbH, 3 pages, (Jun. 1993).

Stabaxol®KE 8059, Rhein Chemie Rheinau GmbH, 2 pages, (Jun. 1993).

Material Data Sheet for Product Stabaxol KE 8059, Rhein Chemie Corporation, 7 pages, (Apr. 1993).

Material Data Sheet for Product Staboxol Masterbatch KE 7646, Rheim Chemie Corporation, 8 pages, (Jan. 1991).

TEFZEL®HT–2127 (flouropolymer) Technical Information Sheet (1 page) (undated).

*Primary Examiner*—James J. Bell

*Attorney, Agent, or Firm*—Renner, Kenner, Greive, Bobak, Taylor & Weber

[57] ABSTRACT

A polyester fabric is formed from a plurality of woven polyester monofilaments. The fabric exhibits improved hydrolytic stability and abrasion resistance. The woven polyester monofilaments are manufactured from a polymer blend comprising at least about 75 percent by weight of a polyester resin, up to about 20 percent by weight of a melt extrudable fluoropolymer resin, and more than 1.5 percent by weight and up to about 5 percent by weight of a hydrolytic stabilizing agent, to form 100 percent by weight of a polymer blend. Such fabrics have utility as fabrics for the dryer sections of paper making machines.

9 Claims, No Drawings

PAPER MAKING FABRIC WOVEN FROM POLYESTER MONOFILAMENTS HAVING HYDROLYTIC STABILITY AND IMPROVED RESISTANCE TO ABRASION

CROSS REFERENCE TO RELATED APPLICATIONS

This application is a continuation-in-part of application U.S. Ser. No. 08/106,272 filed Aug. 12, 1993 now U.S. Pat. No. 5,407,736.

TECHNICAL FIELD

The present invention relates to a paper making fabric woven from polyester monofilaments. More particularly, the invention relates to a fabric woven from polyester monofilaments produced from a blend of a polyethylene terephthalate resin, a melt extruded fluoropolymer resin, and a hydrolytic stabilizer. Specifically, the polyester fabric of the present invention exhibits hydrolytic stability as well as improved resistance to abrasion and contamination, as compared to conventional polyester fabrics and as compared to fabrics woven from conventional polyethylene terephthalate monofilaments containing known quantities of stabilizing agents.

BACKGROUND OF THE INVENTION

Polyester monofilaments have traditionally been used in the paper making industry. Such monofilaments are frequently woven into support belts or fabrics for transporting and dewatering paper sheets produced by paper-making machines. While in use, these fabrics are subjected to demanding conditions that chemically, physically, and mechanically degrade the polyester monofilaments from which the fabrics are made. Specifically, these fabrics are typically subjected to thermal, hydrolytic and abrasive conditions.

Traditionally these fabrics have been manufactured from monofilaments prepared by melt extruding standard polyester resins such as polyethylene terephthalate (PET). This polyester is well-known in the art and has long been used in the production of polyester monofilaments that are suitable for use in the manufacture of paper machine fabrics. PET has a known melting point of less than 260° C. and can be readily adapted for monofilament use. However, while PET has relatively good dry heat (thermal) stability, it has only moderate hydrolytic stability as compared to polyester resins having higher melt temperatures. Furthermore, PET monofilaments have only moderate toughness to abrasion since such monofilaments generally may require replacement within about 30 to 60 days on wear prone forming positions.

With regard to hydrolytic degradation, attempts have been made to improve the hydrolytic stability of PET. For example, Barnewall, U.S. Pat. No. 3,975,329, indicates that the hydrolytic as well as the thermal stability of PET can be improved by melt extruding this standard polyester resin in the presence of a significant amount of a carbodiimide. Specifically, the patent indicates that the amount of carbodiimide used should be equal to the concentration of carboxyl groups in the original resin plus the concentration of carboxyl groups generated when the original resin is extruded in the absence of carbodiimide.

With regard to toughness and abrasion resistance, nylon monofilaments have often been used in combination with polyester monofilaments on high wear positions. The use of nylon, however, may cause some problems in this type of usage due to its high moisture absorption. It has also been known in the art to blend certain fluoropolymers with various thermoplastic resins to achieve a number of desired results. For example, Busse et al. U.S. Pat. No. 3,005,795 teaches the blending of polytetrafluoroethylene (hereinafter PTFE) in powder form to various thermoplastic polymers such as methacrylate polymers, styrene polymers, and polycarbonates. Schmitt et al. U.S. Pat. No. 3,294,871 teaches the blending of PTFE in latex form to various thermoplastic polymers including those mentioned hereinabove. However, in both of these patents, the blends included finely divided microfibrous particles of PTFE which are not suitable for producing polyester monofilaments, as discussed hereinbelow.

At least two patents have blended PTFE with a polyester resin. Notably, Lucas U.S. Pat. No. 3,723,373 teaches the addition of a PTFE emulsion to polyethylene terephthalate (PET) to achieve a material which has greater elongation and improved impact strength. The PTFE emulsion is merely PTFE in the form of a latex dispersion or emulsion with water, mineral oil, benzene or the like. Accordingly, the PTFE emulsion also includes particles of about 0.1 micron to about 0.5 microns in size which comprise about 30 to 80 percent of the emulsion. The PTFE emulsion forms about 0.1 to 2.0 percent by weight of the blend, based upon the weight of the PET. Furthermore, Lucas indicates that this material can be extruded into sheet or stock shapes at a temperature of around 260° C.

Similar to Lucas, Smith U.S. Pat. No. 4,191,678 relates to a fire retardant polymer blend comprising an aqueous colloidal dispersion of PTFE and a polyester resin. Again, however, the PTFE in the dispersion has an average particle size of about 0.2 microns. Smith also indicates that the blend may be subsequently extruded at about 240° C.

The extrusion temperatures of these blends have been noted because it is well known that the melt temperature of PTFE is between about 335° C. and about 343° C. (635°–650° F.), and therefore, when PTFE and the polyester resin are extruded under standard operating conditions at temperatures below 320° C. (608° F.), such as taught by at least one of the above-identified patents, it is clear that the PTFE in the blend must be in the form of solid particles and not in the form of a liquid melt. Importantly, such blends having PTFE in particle form have been found to produce polyester monofilaments that are insufficient for use in paper maker fabrics. The polyester monofilaments are very difficult to extrude because the particles can easily clog or otherwise damage the extrusion equipment that is geared toward producing monofilaments from melted blends. Additionally, when polyester monofilaments are produced from these blends, they have been found to be very rough and not suitable for use in paper maker fabrics. Furthermore, and possibly even more importantly, the PTFE retains its useful properties only up to about 287° C. (550° F.). Accordingly, by melting the PTFE at higher temperatures, all advantages gained by the inclusion of PTFE in these blends would be lost.

Thus, a need exists for a fabric polyester monofilament that is hydrolytically stable and that demonstrates an improved resistance to abrasion and contamination. Attempts have been made to improve the abrasion resistance of monofilaments produced from PET while also improving the hydrolytic stability of the monofilament. For example, Masuda et al., U.S. Pat. No. 5,378,537, teaches a PET monofilament stabilized by the addition of an unaltered carbodiimide compound in the range of from 0.005 to 1.5 percent by weight and a fluorine type polymer in an amount in the range of from 0.01 to 30 percent by weight. The resulting polyester monofilament provides a superior resistance to hydrolysis and proof against staining, compared with the conventional countertype. Despite these improvements, however, Masuda et al. teaches that the physical properties of the monofilament deteriorate when the concentration of the carbodiimide exceeds 1.5 percent by weight.

Therefore, a need still exists, as a result of the deleterious conditions that paper machine fabrics are subjected to during the paper making process, to improve the hydrolytic stability of PET monofilaments, and fabrics made therefrom, while not dissipating the physical properties of the polyester monofilament where amounts larger than 1.5 percent by weight hydrolytic stabilizer are used. Moreover, a further need still exists to improve the abrasion resistance of PET monofilaments, and fabrics made therefrom, in conjunction with improving the hydrolytic stability of such monofilaments and related fabrics while not dissipating the physical properties of the monofilaments or fabrics.

SUMMARY OF INVENTION

It is therefore a primary object of the present invention to provide a paper making fabric woven from extruded polyester monofilaments that exhibit hydrolytic stability as well as improved resistance to both abrasion and contamination, as compared to fabrics made from conventional polyester monofilaments.

It is yet a further object of the present invention to provide a fabric, as above, that exhibits improved resistance to both abrasion and contamination and hydrolytic stability, as compared to conventional fabrics made from stabilized PET monofilaments, without dissipating the physical properties of the polyester fabrics.

It is another object of the present invention to provide a fabric, as above, that exhibits improved toughness and abrasion resistance as compared to conventional polyester fabrics.

It is still another object of the present invention to provide a fabric, as above, that exhibits improved toughness and abrasion resistance as compared to conventional fabrics made from stabilized PET monofilaments, without dissipating the physical properties of the monofilaments or fabrics made therefrom.

It is yet a further object of the present invention to provide a polyester fabric, as above, from extruded polyester monofilaments having a fluoropolymer component which may be extruded at temperatures above its melting point.

At least one or more of these objects, together with the advantages thereof over existing polyester fabrics, including those manufactured from stabilized PET monofilaments, which shall become apparent from the specification which follows, are accomplished by the invention as hereinafter described and claimed.

The present invention provides a polyester fabric formed from a plurality of woven polyester monofilaments. The fabric exhibits improved hydrolytic stability and abrasion resistance. The woven polyester monofilaments are manufactured from a polymer blend comprising at least about 75 percent by weight of a polyester resin, up to about 20 percent by weight of a melt extrudable fluoropolymer resin, and more than 1.5 percent by weight and up to about 5 percent by weight of a hydrolytic stabilizing agent, to form 100 percent by weight of a polymer blend.

PREFERRED EMBODIMENT FOR CARRYING OUT THE INVENTION

The present invention is directed toward a paper making fabric woven from extruded polyester monofilaments. These polyester fabrics exhibit improved hydrolytic stability and resistance to both abrasion and contamination as compared to polyester fabrics currently employed. Moreover, these polyester fabrics exhibit the above mentioned improved characteristics without dissipating the physical properties of the polyester fabrics.

The present invention is directed toward a fabric woven from extruded polyester monofilaments that includes a PET resin stabilized with both a hydrolytic stabilizer and a melt extrudable fluoropolymer resin. Although the prior art does suggest that PET can be stabilized with both a hydrolytic stabilizer and a fluoropolymer, the present invention has obtained and/or maintained superior results as a result of the elevated level of stabilizing additives. In similar fashion, superior fabrics are manufactured from the monofilaments.

It is believed that an increase in the concentration of hydrolytic stabilizing agent will continually increase the hydrolytic stability of an extruded polyester monofilament, at least up to the level later specified. Thus, in an attempt to further increase the hydrolytic stability of the polyester fabric of the present invention, greater levels of hydrolytic stabilizer were added to the monofilament as compared to the amounts specified heretofore in the art. Moreover, these increased levels of hydrolytic stabilizer were added in conjunction with stabilizers employed to increase the toughness and abrasion resistance of the polyester monofilament. Inasmuch as the polyester fabric of the present invention achieved further increases in hydrolytic stability and improved abrasion resistance, and yet did not exhibit any deterioration in physical properties, the present invention is a substantial improvement over all previous polyester fabrics.

The fabric of the present invention is woven from a plurality of the polyester monofilaments described herein, therefore the improved characteristics of the present invention have been characterized by the following. The fact that the novel polyester monofilaments exhibit an increased tensile retention after exposure to moisture at elevated temperatures as compared to conventional polyester monofilaments heretofore employed is indicative of the increased resistance to hydrolytic degradation. Moreover, the fact that the novel polyester monofilaments exhibit increased resistance to abrasion fatigue tests as compared to polyester monofilaments heretofore known in the art is indicative of the increased toughness and abrasion resistance of the resulting monofilaments.

Specifically, the polyester monofilaments employed in the present invention are extruded from a blend of a PET resin, a melt extrudable fluoropolymer resin, and a hydrolytic stabilizing agent. The polyester monofilaments include at least about 75 percent by weight of PET, up to about 20 percent by weight of a melt extrudable fluoropolymer resin, and more than 1.5 percent by weight of a hydrolytic stabilizing agent, to form 100 percent by weight of a polymer blend. Preferably, the polymer blend contains from about 75 to about 98.3 percent by weight of PET, from about 0.2 to about 20 percent by weight of a melt extrudable fluoropolymer resin, and more than 1.5 percent by weight, up to about 5 percent by weight of a hydrolytic stabilizing agent, to form about 100 percent by weight of a polymer blend. Most preferably, the polyester monofilaments contain from about 87 to about 96 percent by weight of PET, from about one to about 10 percent by weight of a melt extrudable fluoropolymer resin, and up to about three percent by weight of a hydrolytic stabilizing agent, to form about 100 percent by weight of a polymer blend.

As mentioned, the polyester monofilaments of the present invention include a polyethylene terephthalate (PET) resin. Notably, PET resins have a melt temperature below 260° C. (500° F.) and are typically formed from ethylene glycol by direct esterification or by catalyzed ester exchange between ethylene glycol and dimethyl terephthalate. However, other processes for producing PET may also be available and are well known in the art. PET is suitable for use in forming monofilaments because it has dimensional stability and low moisture regain, preferred in forming and dryer fabrics.

Preferred examples of PET resins useful in the present invention are those produced by E.I. du Pont de Nemours & Co. under the trademark CRYSTAR. These particular PET resins have a melt temperature of about 257° C. (495° F.) and an intrinsic viscosity of from about 0.70 to about 0.97. It has been found that for purposes of this invention the use of a PET resin having an intrinsic viscosity of about 0.72 will facilitate blending and extrusion. Nonetheless, the use of a PET resin having other intrinsic viscosities should not be precluded.

Furthermore, the polyester monofilaments of the present invention include a hydrolytic stabilizing agent. Most hydrolytic stabilizing agents are carbodiimides. Examples of preferred carbodiimides include aromatic polycarbodiimides such as 2,4-diisocyanato-1,3,5-tris(1-methylethyl) copolymer with 2,6-diisopropyl diisocyanate and benzene-2,4-diisocyanato-1,3,5-tris(1-methylethyl)homopolymer, also produced by Rhein-Chemie under the tradenames Stabaxol P and Stabaxol P100, respectively. It will be understood that other compounds may also be employed without departing from the spirit of the invention and that the invention is not necessarily limited to the carbodiimides exemplified. For example, mixtures of these carbodiimides may also be employed. Such mixtures are often premixed, or masterbatched, prior to combining with other resins of the present invention. For example, Staboxol P and Stabaxol P100 are combined to form Stabaxol 8059 Masterbatch, which includes 8 percent by weight Stabaxol P and 7 percent Stabaxol P100. Another example is Stabaxol KE 7646, which includes 15 percent by weight Stabaxol P100.

Lastly, the polymer blend which forms the polyester monofilaments of the present invention further includes a melt extruded fluoropolymer resin. By the term "melt extruded," it is meant that, in the extrusion process, the fluoropolymers melt and become a liquid under standard processing conditions. Typically, standard processing conditions do not involve temperatures above about 320° C. (608° F.). Accordingly, the fluoropolymers employed in the present invention have a melt temperature below about 320° C. and preferably melt within the normal extrusion operating temperature range of about 170° C. to 320° C. (338° to 608° F.), and even more desirably within the range of about 250° C. to 280° C. Therefore, at normal operating temperatures, the entire blend of polyester resin and fluoropolymer additive will be in the melt phase and is melt processible.

Fluoropolymer resins useful in the present invention are typically copolymers of ethylene and halogenated ethylene, although they are not necessarily limited thereto. More specifically, examples of fluoropolymers useful in the present invention and having melt temperatures below about 320° C. include ethylene tetrafluoroethylene copolymers such as those produced by E.I. du Pont de Nemours & Co., of Wilmington, Del., under the trademark TEFZEL; tetrafluoroethylene hexafluoropropylene copolymers such as those produced by E.I. du Pont de Nemours & Co. under the trade name TEFLON FEP; and polyfluoroalkoxy copolymers such as those produced by E.I. du Pont de Nemours & Co. under the trade name TEFLON PFA. In addition, polyvinylidene fluoride copolymers and ethylene chlorotrifluoroethylene copolymers may also be a suitable fluoropolymer for extrusion purposes, as well as mixtures of the melt extrudable fluoropolymers discussed herein. TEFZEL and TEFLON are registered trademarks of E.I. du Pont de Nemours & Co.

All of the fluoropolymers mentioned hereinabove melt in the temperature range of about 170° C. to 320° C. (338° to 608° F.), and therefore, are in the liquid phase, along with the polyester resin employed, when extruded at temperatures below about 320° C. Notably, TEFZEL melts between about 245° C. to 280° C. (473° to 536° F.); TEFLON FEP melts within the range of about 260° C. to 285° C. (500° to 545° F.); and TEFLON PFA melts between about 300° C. and 310° C. (572° to 590° F.). Additionally, polyvinylidene fluoride copolymers and ethylene chlorotrifluoroethylene copolymers melt below 320° C.

It should be understood that any polyester resin and melt extrudable fluoropolymer resin suitable for the functional requirements described herein may be used in the present invention, and any examples provided herein are not intended to limit the present invention to those particular resins or to those particular amounts, unless otherwise indicated.

POLYESTER MONOFILAMENT EXAMPLES

To demonstrate the improved properties of the present invention over those properties achieved with polyester fabrics heretofore known in the art, five (5) polyester monofilaments, which are woven to produce the fabric of the present invention, were blended, extruded, and subjected to various tests. The blending generally entails blending about two percent by weight of the desired fluoropolymer with from about 95 to about 98 percent by weight of polyester resin, and subsequently adding from 0 to about three percent by weight of the desired hydrolytic stabilizer, to achieve 100 percent by weight of the polymer blend. The polymer blend may then be extruded, preferably by a process of melt extrusion at temperatures below about 320° C., to produce the improved abrasion resistant polyester monofilament of the present invention. The PET resin employed in the present examples was standard PET such as Crystar, having a melt temperature of about 257° C. and an intrinsic viscosity of about 0.72, while the fluoropolymer was Tefzel HT-2127, and the polycarbodiimide was a masterbatch blend of Stabaxol P and Stabaxol P100 carbodiimide (Stabaxol 8059). The varying concentrations employed are represented in Table I hereinbelow. Samples 4 and 5 are representative of the present invention.

TABLE I

| POLYESTER MONOFILAMENT CONSTITUENT CONCENTRATION (% BY WEIGHT) | | | | | |
|---|---|---|---|---|---|
| Monofilament Sample | 1 | 2 | 3 | 4 | 5 |
| PET | 98.0 | 97.25 | 96.5 | 95.75 | 95.0 |
| Fluoropolymer | 2.0 | 2.0 | 2.0 | 2.0 | 2.0 |
| Polycarbodiimide | 0.00 | 0.75 | 1.50 | 2.25 | 3.00 |

Upon extrusion, the above listed polyester monofilaments were eventually subjected to a variety of tests to determine the physical properties of each of the polyester monofilaments. The results of these tests have been reported in Table II hereinbelow.

TABLE II

| | PHYSICAL PROPERTIES | | | | |
|---|---|---|---|---|---|
| Monofilament Sample | 1 | 2 | 3 | 4 | 5 |
| Diameter (in) | 0.0197 | 0.0198 | 0.0198 | 0.0197 | 0.0199 |
| Tensile Strength, lbs (std. dev.) | 23.51 (0.34) | 23.75 (0.36) | 23.30 (0.25) | 24.03 (0.19) | 23.83 (1.35) |
| Tenacity, gpd (std. dev.) | 4.35 (0.06) | 4.35 (0.06) | 4.27 (0.05) | 4.45 (0.04) | 4.32 (0.25) |
| Elongation at Break, % (std. dev.) | 37.32 (1.03) | 38.03 (1.04) | 39.17 (1.00) | 38.67 (1.01) | 38.06 (1.64) |
| Elongation at 3.00, gpd (std. dev.) | 20.56 (0.43) | 20.92 (0.23) | 21.86 (0.27) | 20.80 (0.34) | 21.47 (1.49) |

As shown in Table II, the physical properties most sought in the polyester monofilament art were tested. The physical characteristics obtained were characteristic of most, if not all, other polyester monofilaments. Most important to the present invention is the fact that the increasing levels of polycarbodiimide in the polyester monofilaments did not deteriorate the physical properties of the monofilaments.

The polyester monofilaments listed above in Table I were then subjected to a hydrolytic stability test. Particularly, the above samples were exposed to saturated steam at a temperature of about 121° C. (250° F.) and a pressure of about 15 psi for 0 to 19 days. Data regarding the tensile strength was determined and the percent of tensile retention was calculated. Table III represents this test data over a nineteen-day period as reported hereinbelow.

TABLE III

| HYDROLYTIC STABILITY | | | | | |
|---|---|---|---|---|---|
| Monofilament Sample | % TENSILE RETENTION | | | | |
| Exposure (Days) | 1 | 2 | 3 | 4 | 5 |
| 0 | 100 | 100 | 100 | 100 | 100 |
| 3 | 82 | 93 | 98 | 95 | 90 |
| 5 | 37 | 91 | 90 | 94 | 100 |
| 7 | 0 | 77 | 89 | 91 | 91 |
| 10 | — | 0 | 71 | 82 | 97 |
| 12 | — | — | 45 | 69 | 83 |
| 14 | — | — | 22 | 47 | 83 |
| 17 | — | — | 0 | 0 | 64 |
| 19 | — | — | — | — | 38 |

As shown in Table III, after only 7 days, the polyester monofilament containing no polycarbodiimide no longer exhibited a percent tensile retention. On the other hand, after 7 days, those monofilaments containing polycarbodiimide maintained a percent tensile retention of at least 77 in the case of the monofilament containing 0.75 percent by weight polycarbodiimide, and as high as 91 in the case of monofilaments containing 2.25 and 3.00 percent by weight polycarbodiimide. This clearly represents proof that polycarbodiimde will impart significant hydrolytic stability to PET monofilaments and, in turn, to polyester fabrics. More importantly, the data clearly represents the fact that there is a direct relationship between the level of hydrolytic stability and the concentration of hydrolytic stabilizer added, at least up to 3.00 percent by weight polycarbodiimide. As the data represents, the polyester monofilament containing 3.00 percent polycarbodiimide had a 38 percent tensile retention while all the other monofilaments lost complete tensile retention after 19 days. Thus, it is desirable to increase the amount of hydrolytic stabilizer added to polyester monofilaments in order to obtain a maximum hydrolytic stability.

In order to demonstrate the improved toughness and abrasion resistance of the polyester monofilaments, which are woven to produce the fabric of the present invention, three (3) additional monofilaments were blended, extruded and subjected to abrasion testing. These monofilaments were prepared as follows. Sample A comprised PET having an intrinsic viscosity of about 0.72 stabilized with 1.3 percent by weight monomeric carbodiimide (Stabaxol-I). Sample B comprised PET having an intrinsic viscosity of about 0.72 stabilized with 2.25 percent polymeric carbodiimide (Stabaxol KE 8059 at 15%). Sample C comprised PET having an intrinsic viscosity of about 0.72 stabilized with 2.25 percent by weight polymeric carbodiimide (Stabaxol KE 8059 at 15%) and 2.00 percent by weight Tefzel HT-2127. All polyester monofilaments were processed in the temperature range 550° F. to 570° F. (287° to 299° C.).

Squirrel cage fatigue tests were conducted in a squirrel cage abrader which consists of twelve equally spaced carbon steel bars on an approximately 25.5 cm diameter bolt circle rotating about a common axis. Each bar is about 3.1 mm in diameter and about 60.5 cm long with its axis parallel to a central axis. Each polyester monofilament is tied to a microswitch by means of a slip knot and then draped over the bars and pretensioned with a free hanging weight. The microswitch is pretensioned so that a maximum of about 36 cm of monofilament is contacted by the bars at any one time. The free hanging weights weigh 500 grams each and up to twelve monofilament strands can be tested at one time. The bars rotate about the common axis at 160 rpm, and the test is continued until the monofilaments are severed. The life of the monofilament while on the squirrel cage is measured in cycles to break, which represents the revolutions required to sever the monofilament.

Sandpaper abrasion tests were conducted on a sandpaper abrasion equipment. Sandpaper abrasion test equipment consists of a continuously moving strip of sandpaper wrapped more than 180° around a support roll (3.2 cm diameter). The axis of the support roll is parallel to the floor. Guide rollers allow the test monofilament to contact 3.5 linear cm of sandpaper. The 320J grit sandpaper moves at 4 inches per minute in a direction that results in an upward force on the monofilament. A downward force is maintained by tensioning the monofilament with 500 grams of free hanging weight. The monofilament cycles clockwise and counterclockwise on the sandpaper with a traverse length of 3 cm. The filament is strung across a microswitch which stops when the filament breaks. Results are recorded as cycles to break.

Each of the polyester monofilaments were subjected to squirrel cage fatigue testing and sandpaper abrasion testing, the results of which have been presented in Table IV hereinbelow.

TABLE IV

PHYSICAL PROPERTIES - ABRASION RESISTANCE

| Monofilament Sample | A | B | C |
|---|---|---|---|
| Squirrel Cage (Cycles) | 3034 | 3479 | 4526 |
| Sandpaper (Cycles) | 98 | 99 | 120 |

As shown in Table IV, the extruded polyester monofilaments of the present invention (Sample C) had up to about 50 percent greater resistance to flexural abrasion in the squirrel cage abrader and up to about 23 percent greater resistance to abrasion in the sandpaper abrader as compared to the PET stabilized monofilaments heretofore known in the art (Sample A). Thus, it should be clear, based on the results represented in Table IV, that the addition of a melt extrudable fluoropolymer significantly improves the toughness and abrasion resistance of PET monofilaments.

Samples A, B and C, listed above, were then subjected to a hydrolytic stability test. Particularly, the above samples were exposed to saturated steam at a temperature of about 121° C. (250° F.) and a pressure of about 15 psi 0 to 16 days. Data regarding the tensile strength was determined and the percent of tensile retention was calculated. For purposes of this hydrolytic stability test, a control was also tested which comprised a monofilament containing only PET resin. Table V represents this test data over a sixteen-day period as reported hereinbelow.

TABLE V

HYDROLYTIC STABILITY

| Monofilament Sample | % TENSILE RETENTION | | | |
|---|---|---|---|---|
| Exposure (Days) | Control | A | B | C |
| 0 | 100 | 100 | 100 | 100 |
| 3 | 73 | 93 | 96 | 90 |
| 7 | 0 | 92 | 96 | 91 |
| 9 | — | 87 | 92 | 86 |
| 11 | — | 86 | 88 | 84 |
| 14 | — | 56 | 63 | 55 |
| 16 | — | 0 | 41 | 40 |

Based on the results represented in Table V it should be clear, as it was demonstrated earlier, that the addition of a hydrolytic stabilizing agent will greatly improve the hydrolytic stability of PET monofilaments. Moreover, it should be clear, based on the data demonstrated in Table V, that the addition of a fluoropolymer such as Tefzel will not hinder the hydrolytic stability of the PET monofilament.

In conclusion, it should be clear from the foregoing examples and specification that the stabilized PET monofilaments disclosed herein exhibit increased resistance to abrasion and contamination, as well as improved hydrolytic stability, as compared to conventional stabilized PET monofilaments, without dissipating the physical properties of the monofilament. Accordingly, the polyester fabrics of the present invention, produced from these polyester monofilaments, also exhibit the improved properties.

Practice of the process of the present invention should not necessarily be limited to the use of a particular extruder, extrusion temperatures, quench temperature, draw ratio, relaxation ratio or the like that may be employed to extrude polyester monofilament. It should be understood that accommodations for differences in equipment, the size and shape of the monofilament, and other physical characteristics of the monofilament of the present invention other than those expressly noted herein are not relevant to this disclosure, can readily be made within the spirit of the invention. Likewise, the fabrics of the present invention should not necessarily be limited to any particular weave.

Lastly, it should be appreciated that the polyester monofilaments described herein have utility in woven fabric such as is useful as paper machine fabric. The fabrics woven from the polyester monofilaments demonstrate improved hydrolytic stability as well as increased toughness and abrasion resistance, without dissipating the physical properties of the monofilaments comprising the fabric. Based upon the foregoing disclosure, it should now be apparent that the use of the polyester monofilament and fabric described herein will carry out the objects set forth hereinabove. It is, therefore, to be understood that any variations evident fall within the scope of the claimed invention and thus, the selection of specific component elements can be determined without departing from the spirit of the invention herein disclosed and described. Thus, the scope of the invention shall include all modifications and variations that may fall within the scope of the attached claims.

What is claimed is:

1. A fabric having improved hydrolytic stability and abrasion resistance comprising:

a plurality of woven polyester monofilaments; said polyester monofilaments being formed from a polymer blend comprising:

at least about 75 percent by weight of polyethylene terephthalate resin;

up to about 20 percent by weight of a melt extrudable fluoropolymer resin; and more than about 1.5 percent by weight and up to about 5 percent by weight of a hydrolytic stabilizing agent, to form 100 percent by weight of said polymer blend.

2. A fabric, as in claim 1, wherein said hydrolytic stabilizing agent is a carbodiimide selected from the group consisting of polycarbodiimides.

3. A fabric, as in claim 2, wherein said carbodiimide is selected from the group consisting of benzene-2,4-diisocyanato-1,3,5-tris(1-methylethyl) homopolymer, 2,4-diisocyanato-1,3,5-tris(1-methylethyl)copolymer with 2,6-diisopropyl diisocyanate, and mixtures thereof.

4. A fabric for use in paper making machines comprising the fabric of claim 1.

5. A fabric, as in claim 1, wherein said fluoropolymer resin has a melt temperature below about 320° C.

6. A fabric, as in claim 1, wherein said fluoropolymer resin melts at temperatures of between about 170° C. to 320° C.

7. A fabric, as in claim 1, wherein said fluoropolymer resin is selected from the group consisting of ethylene tetrafluoroethylene copolymers, polyvinylidene fluoride copolymers, tetrafluoroethylene hexafluoropropylene copolymers, polyfluoroalkoxy copolymers, and ethylene chlorotrifluoroethylene copolymers.

8. A fabric, as in claim 1, wherein said polyester monofilament comprises:

from about 87 to about 96 percent by weight of polyethylene terephthalate resin;

from about one to about 10 percent by weight of a melt extrudable fluoropolymer resin; and up to about three percent by weight of a hydrolytic stabilizing agent, to form 100 percent by weight of said polymer blend.

9. A fabric having improved hydrolytic stability and abrasion resistance comprising:

a plurality of woven polyester monofilaments; said polyester monofilaments being formed from a polymer blend comprising:

from about 75 to about 98.3 percent by weight of polyethylene terephthalate resin;

from about 0.2 to about 20 percent by weight of a melt extrudable fluoropolymer resin; and more than about 1.5 percent by weight and up to about 5 percent by weight of a hydrolytic stabilizing agent, to form 100 percent by weight of said polymer blend.

* * * * *